US005421986A

United States Patent [19]

Defer et al.

[11] Patent Number: 5,421,986

[45] Date of Patent: Jun. 6, 1995

[54] METHOD OF REGULATING ELECTRO-DEPOSITION ONTO A METAL STRIP

[75] Inventors: Marc Defer, Basse-Ham; Jean-Michel Walter, Thionville, both of France

[73] Assignee: Sollac, Puteaux, France

[21] Appl. No.: 220,981

[22] Filed: Mar. 31, 1994

[30] Foreign Application Priority Data

Apr. 22, 1993 [FR] France ..... 93 04878

[51] Int. Cl.[6] ..... C25D 7/06

[52] U.S. Cl. ..... 205/83

[58] Field of Search ..... 205/83

[56] References Cited

U.S. PATENT DOCUMENTS 4,240,881 12/1980 Stanya ..... 205/83

4,699,694 10/1987 Backelandt ..... 205/83

FOREIGN PATENT DOCUMENTS 2590278 11/1985 France .

*Primary Examiner*—John Niebling

*Assistant Examiner*—Brendan Mee

*Attorney, Agent, or Firm*—Laubscher & Laubscher

[57] ABSTRACT

One side of a metal strip forming a cathode is fed continuously at a given rate in an electrolyte past anodes supplied by respective controllable rectifiers. The strip is divided into increments of fixed length and predetermined width and coating rate. A total current for coating the increments is determined beforehand. The regulation method then includes determining the number of rectifiers to be put into operation, determining a predicted current for each rectifier by equally distributing the total current between said rectifiers to be put into operation, and determining current orders to be applied to the rectifiers to be put into operation. The method is cyclic for each side of the strip.

12 Claims, 8 Drawing Sheets

E63
NB > 0
no
E70
yes
CUMULDISPO ≥ CUMULAREPARTIR
and
CUMULAREPARTIR ≠ 0
no
E71
n = 2
E72
no
IPREV(n) > 0
yes
E73
yes
CUMULAREPARTIR ≥ IBUTEE(n) − IPREV(n)
no
E74
CUMULAREPARTIR =
CUMULAREPARTIR −
(IBUTEE(n) − IPREV(n))
IPREV(n) = IBUTEE(n)
IPREV(n) =
IPREV(n) +
CUMULAREPARTIR
n = n + 1
E80
(FIG.8)
yes
n ≤ N − 1
no
E64
E75
yes
? ETATCONSIGNE(n) = 0
2 ≤ n ≤ N − 1
no
E76
∀n, 2 ≤ n ≤ N − 1
ETATCONSIGNE(n) = 1
NBR = NBR + 1
IMOY = (ITOTAL − IBUTEE(1)) / NBR
E51
(FIG.5)

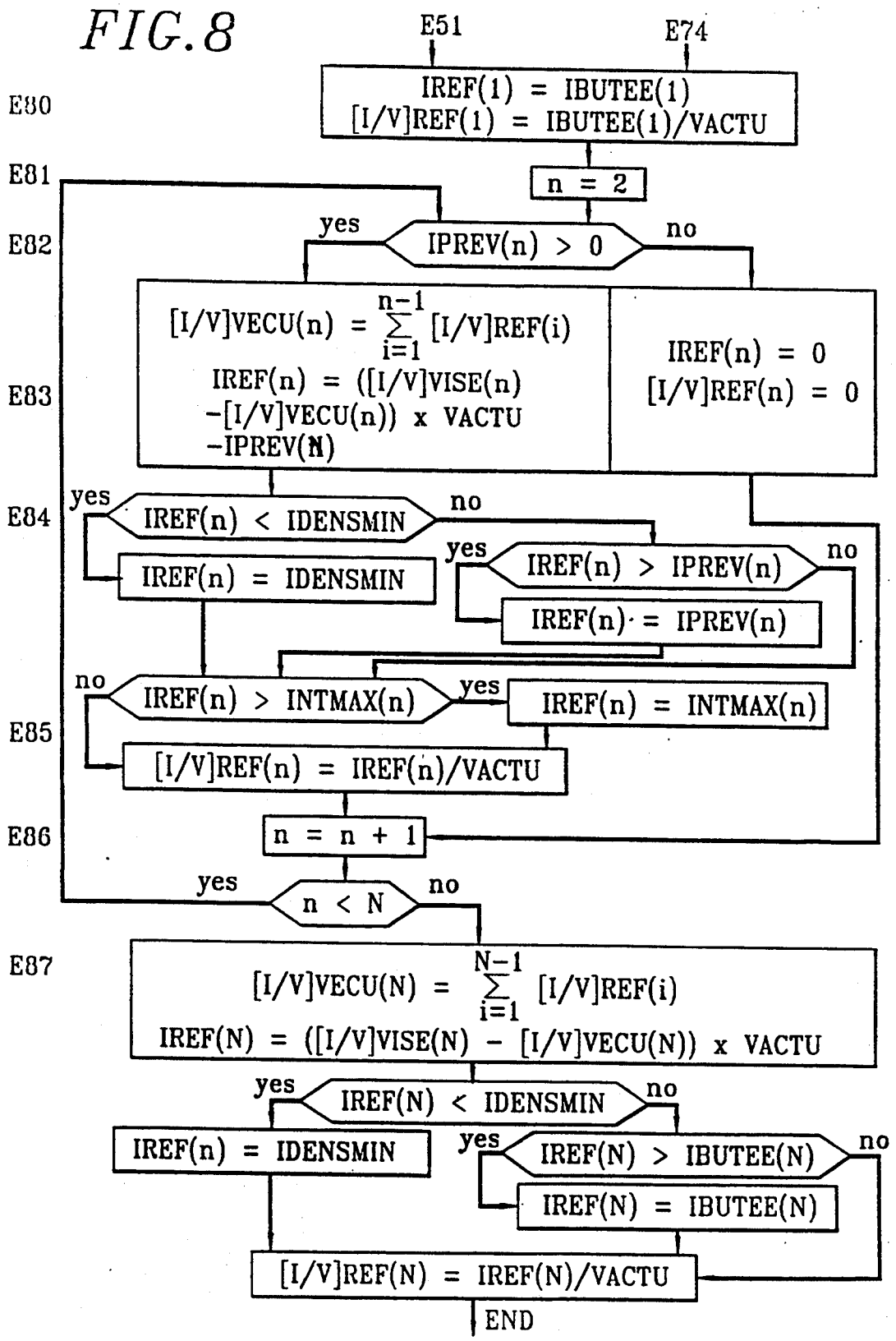
FIG. 8
E51
E74
E80
IREF(1) = IBUTEE(1)
[I/V]REF(1) = IBUTEE(1)/VACTU
E81
n = 2
E82
yes
IPREV(n) > 0
no
E83
[I/V]VECU(n) = Σ i=1 n-1 [I/V]REF(i)
IREF(n) = ([I/V]VISE(n) -[I/V]VECU(n)) x VACTU -IPREV(n)
IREF(n) = 0
[I/V]REF(n) = 0
E84
yes
IREF(n) < IDENSMIN
no
IREF(n) = IDENSMIN
yes
IREF(n) > IPREV(n)
no
IREF(n) = IPREV(n)
E85
no
IREF(n) > INTMAX(n)
yes
IREF(n) = INTMAX(n)
[I/V]REF(n) = IREF(n)/VACTU
E86
n = n + 1
yes
n < N
no
E87
[I/V]VECU(N) = Σ i=1 N-1 [I/V]REF(i)
IREF(N) = ([I/V]VISE(N) - [I/V]VECU(N)) x VACTU
yes
IREF(N) < IDENSMIN
no
IREF(n) = IDENSMIN
yes
IREF(N) > IBUTEE(N)
no
IREF(N) = IBUTEE(N)
[I/V]REF(N) = IREF(N)/VACTU
END

METHOD OF REGULATING ELECTRO-DEPOSITION ONTO A METAL STRIP

BACKGROUND OF THE INVENTION

1. Field of the Invention

The present invention is generally concerned with the electro-deposition of metal onto a continuously moving metal strip.

It is more particularly concerned with a method of regulating electrolytic deposition of a metal coating onto a metal strip forming a cathode and moving continuously at a given feed rate in an electrolyte past periodically disposed anodes. The anodes are supplied with direct current by respective controllable rectifiers, and the coating deposited on the strip depends on the output current of each rectifier.

2. Description of the Prior Art

One example of the use of the technique of electrodeposition of metal is the tinning of a metal strip as described in U.S. Pat. No. 4,699,694 which relates more particularly to the regulation of the deposition of metal by means of a microprocessor. This patent describes a method of regulating the quantity of metal deposited electrolytically onto a strip to be coated that moves continuously in a deposition installation including a plurality of storage tanks filled with electrolyte. The strip passes over a conductive roller forming a cathode associated with each storage tank and the coating metal is supplied by bars of said metal carried by conductive bridges and forming anodes disposed in each storage tank along part of the path of the strip in said tank.

The regulating method of the aforementioned U.S. patent consists in calculating for each displacement of the strip between two successive bridges the deposition of metal under each bridge as a function of the current intensity fed to that bridge, the strip feed rate and the efficiency of the bridge, monitoring separately each length of strip equal to the distance between two successive bridges by cumulating the successive deposits of metal, establishing the deposit balance under the last bridge carrying current in order to determine the current required under this bridge to complete the deposition of metal, determining the overall current intensity required to obtain the necessary current intensity under this final bridge, and on each acquisition of an average measurement across the entire width of the strip calculating, allowing for the transfer distance, the difference between this average value and a predetermined order value to determine a correction coefficient for the theoretical efficiency of the deposition of metal under each bridge. The method includes measuring the metal deposited on each side using a periodic scanning gauge disposed at the exit of the installation, deposition being controlled on the basis of data supplied by the gauge.

This method reduces the sensitivity of the installation to speed fluctuations, as compared with manual installations. However, a method of this kind does not totally overcome the problem of coating fluctuations.

SUMMARY OF THE INVENTION

The main object of the present invention is to provide a method of regulating electrolytic coating which adapts rapidly to coating fluctuations so that only a short length of strip is rejected in the event of coating fluctuations.

Another object of this invention is to provide a coating regulation method that is insensitive to speed fluctuations.

Accordingly there is provided a method of regulating electrolytic deposition of a metal coating onto one side of a metal strip. The metal strip forms a cathode and is fed continuously at a set feed rate in an electrolyte past anodes. The anodes are supplied by respective controllable rectifiers having respective upper and lower current limits. The metal strip is divided into increments of fixed length. Each increment has a predetermined width and a predetermined coating rate. After having determined a total current required to coat the increments between the anodes as a function of the coating rate, width and feed rate, the method includes the steps of determining a number of rectifiers to be put into operation as a function of the necessary total current and the lower current limits of the rectifiers, determining a predicted current for each rectifier by distributing the necessary total current equally between the rectifiers to be put into operation between said respective upper and lower current limits, and determining current orders (i.e. current set values) to be applied to the rectifiers to be put into operation, a current order or set value for a given rectifier supplying a respective anode depending on the strip width and the coating rate of a strip increment passing the respective anode and on the current orders of the rectifiers preceding said given rectifier and being less than the predicted current of the given rectifier. The method is employed in a cyclic manner for each side of the strip to be coated.

The required total current is advantageously the total current required to coat one of the increments for which the product of the width by the coating rate is highest. In this way overcoating is imposed relative to undercoating in the vicinity of a weld between two successive strip portions to have different coating thicknesses.

According to another feature of the invention, the number of rectifiers to be used depends on a required current density for coating and a minimal current density for the coating below which the current density must not fall. The current density affects the appearance of the coating.

According to another aspect of the invention the predicted current for each rectifier is determined in dependence on an in-service or out-of-service status of said each rectifier and reserved and unreserved status of the rectifiers.

The cyclic determination of a predicted current for each rectifier does not depend on the reserved status of the rectifiers if equal distribution of the required total current is not possible on the rectifiers with the unreserved status only. In all cases determination of the predicted currents of the rectifiers yields a set of non-null predicted currents associated with the rectifiers put into operation and a set of null predicted currents.

According to another feature of the invention the cyclic determination of the rectifier current orders yields a set of non-null current orders associated with the rectifiers put into operation and a set of null current orders. A null predicted current for a given rectifier produces a null current order for said given rectifier and likewise a non-null rectifier predicted current for another rectifier produces a non-null current order for said another rectifier.

According to a further feature of the invention the method, i.e., the step of determining the current order for each rectifier, comprises calculating a ratio of the current order of said each rectifier and the feed rate of the metal strip rate and assigning this ratio to a strip increment passing the anodes supplied by said each rectifier.

For determining the current order for the strip increment passing the respective anode supplied by the given rectifier, the method includes calculating a history which is the sum of ratios of the current orders and the feed rate. The ratios are calculated for the upstream rectifiers preceding said given rectifier in the strip feed direction and assigned to the strip increment passing the respective anode supplied by the given rectifier.

The calculation of the current order for each rectifier advantageously allows for the history of the strip increment passing the anodes fed by said each rectifier.

At least one rectifier is preferably always put into operation, and this rectifier is the last rectifier which supplies an anode before which said one metal strip side has not been subject to said electrolytic deposition.

Each in-service rectifier advantageously receives a current order at least equal to, i.e., greater than or equal to, a predetermined minimal value.

In another aspect of the invention a first rectifier which supplies an anode after which said one metal strip side is coated with said metal coating is always put into operation and receives a current order equal to a predetermined value.

BRIEF DESCRIPTION OF THE DRAWINGS

The foregoing and other features and advantages of the present invention will be apparent from the following description of several preferred embodiments of the invention with reference to the corresponding accompanying drawings in which:

FIG. 8 is an algorithm for determining current orders applied to the rectifiers.

DETAILED DESCRIPTION OF THE PREFERRED EMBODIMENTS

Figure 1:
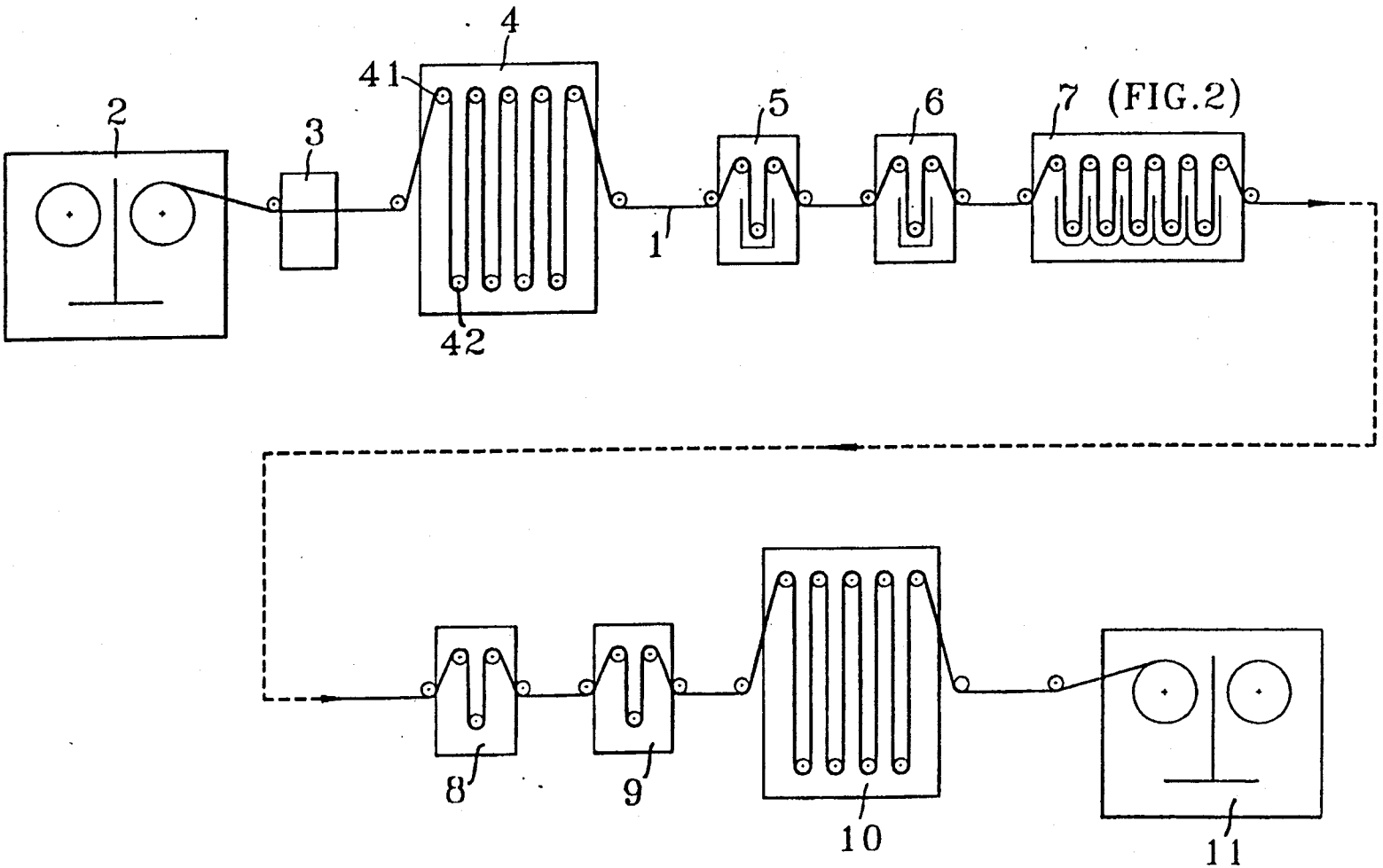
FIG. 1 is a diagrammatic representation of an electrolytic tinning line.

Referring to FIG. 1, a steel tinning line comprises at the upstream end an unwinding device 2 which unwinds spools of steel strip to be tinned a priori having various widths and lengths. A welding device 3 butt joints the metal strips at the end of one spool and at the start of the next spool in order to form a continuous steel strip 1. The strip 1 passes through an loop tower 4 which includes top rollers 41 and bottom rollers 42.

The strip 1 passes around the top and bottom rollers alternately so that the loop tower serves as a strip accumulator. During the welding of the end of the strip from one spool to the start of the strip from the next spool, feeding of the strip is halted at the welding device 3. The bottom rolls 42 of the loop tower 4 rise gradually towards the top rolls 41 to reduce the accumulated quantity of strip 1 so that the part of the line downstream of the loop tower 4 is fed continuously. On completion of the welding operation the movement of the strip from the new spool to the loop tower 4 restarts, and the loop tower accumulates a further quantity of strip by gradual lowering of the bottom rollers. In this way the spool changing and welding operations do not interfere with the movement of the strip on the downstream side of the loop tower 4, which movement is continuous.

On leaving the loop tower the strip 1 enters a degreasing unit 5 and a pickling unit 6 to prepare the surface of the strip to be tinned. The strip 1 then passes through a tinning unit 7 to be described in detail with reference to FIG. 2. After tinning the strip enters a remelting device 8 which remelts the tin to improve the adhesion of the tin and resistance to corrosion. The strip 1 then passes through a chemical treatment device 9 for passivating the tinned surface, for example by chromate treatment. Passivation also improves corrosion resistance and in particular the adhesion of lacquer to the tinned surface.

The strip 1 then passes through a second loop tower 10 to a cutting and spooling device 11 where the strip is spooled into spools. The loop tower 10 has an accumulator function which is the converse of that of the loop tower 4. When the cutting and spooling device 11 completes a spool, and before starting the next spool, the loop tower accumulates the strip to be spooled until the spooling device is ready to spool the next spool.

The tinned steel spools are then cut, shaped and assembled to form packagings for food products, for example.

Figure 2:
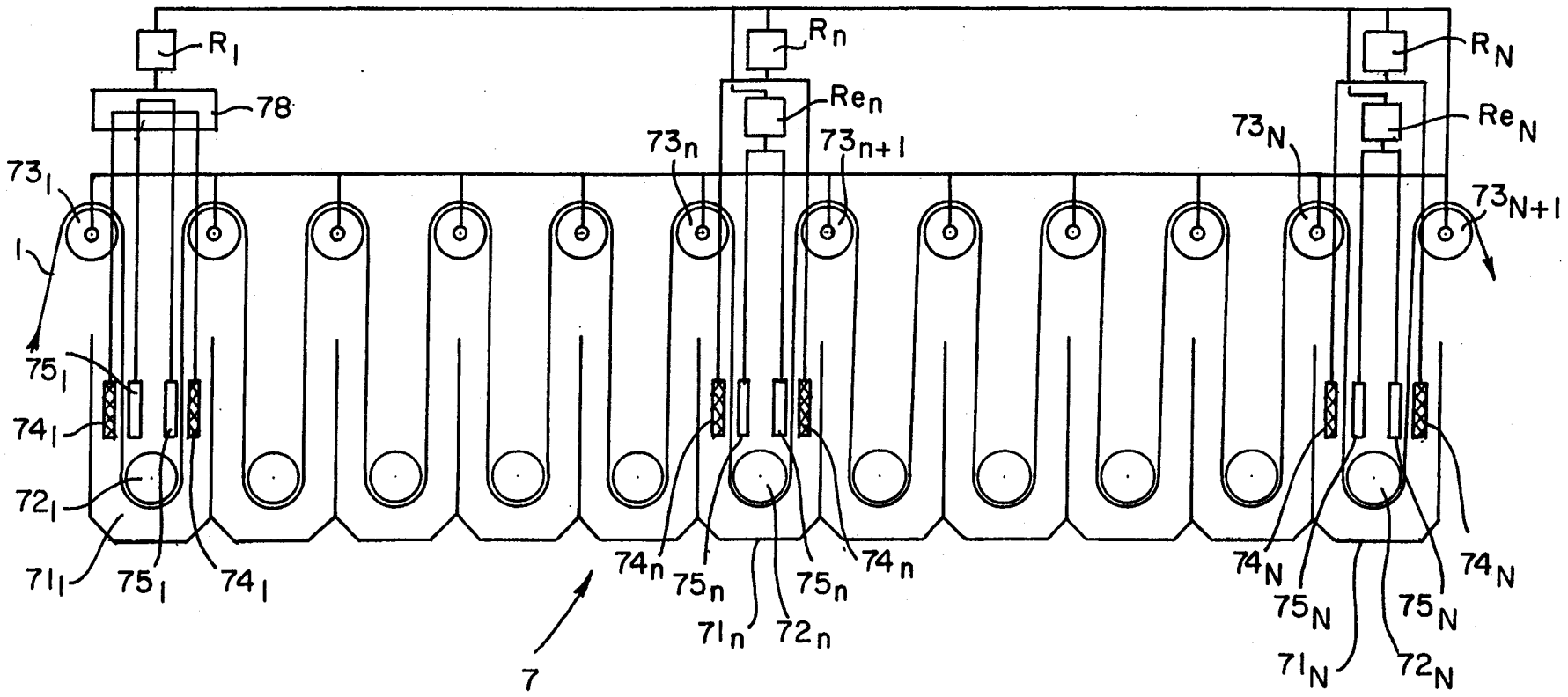
FIG. 2 is a diagrammatic view in longitudinal cross-section of a tinning unit included in the line from FIG. 1.

Referring to FIG. 2, the tinning unit 7 comprises N identical tanks $71_1$ through $71_N$ containing electrolyte, not shown, each tank constituting one basic "period" of the unit 7. N is a positive integer, equal to ten or eleven, for example. To avoid overcomplicating FIG. 2, only the first tank $71_1$, an arbitrary intermediate tank $71_n$ and the last tank $71_N$ are shown in full, n being an integer lying between 1 and N. A direction changer roller $72_1$ through $72_N$ around which the strip 1 to be tinned passes continuously is rotatably mounted in the bottom of each tank. The rollers $72_1$ through $72_N$ are made from a non-conductive material. Conductive material second rollers $73_1$ through $73_{N+1}$ above transverse walls of the tanks tension the strip and transfer it through all the tanks in succession.

In each of the N tanks $71_1$ through $71_N$ the strip is fed between two pairs of vertical anodes $74_1$ and $75_1$ through $74_N$ and $75_N$ in the form of tin bars juxtaposed vertically in a support. Each anode faces a lengthwise portion of one of the top and bottom sides of the strip which constitutes the cathode for the electrolytic reaction. The rollers $73_1$ through $73_{N+1}$ and consequently the strip 1 are at the same cathode potential.

At the first tank $71_1$ a rectifier $R_1$ feeds direct current through a current divider 78 to the pair of anodes $74_1$ facing a portion of the bottom side of the strip and the pair of anodes $75_1$ facing a portion of the top side of the strip. In any of the N−1 subsequent tanks $71_n$ a controlled rectifier $R_n$ feeds the two anodes facing the bottom side of the strip and an analogous rectifier $Re_n$ feeds the two anodes facing the top side of the strip. In an alternative embodiment (not shown) each of the two pairs of anodes in the first tank is fed by a respective rectifier in a similar manner to the subsequent N−1 tanks. In a further embodiment, in one or more tanks containing two pairs of anodes each anode is fed by an individual rectifier.

A device for measuring the strip feed rate in the form of a feed pulse generator for example is disposed in the tinning unit 7.

The top or bottom side of the strip 1 is tinned by virtue of an electrolytic reaction between the cathode, i.e. the strip, and the succession of anodes facing that side. Each of the anodes being fed with a direct current by a rectifier, the electrolytic reaction between this side of the strip and the anode depends on the current supplied by the rectifier. The tinning of one side is independent of the tinning of the other side, ignoring leakage currents.

At any given time the length of strip in the tinning unit 7 between the end top rollers $73_1$ and $73_{N+1}$ is divided into a series of N fixed length strip increments. The length of an increment is, for example, equal to the length of strip between horizontal tangents to the tops of two successive top rollers $73_n$ and $73_{n+1}$. A strip increment is characterized by its width and by the coating thicknesses specified for the sides of the increment. This increment length is independent of the location of the anode pairs: for example, an anode pair for coating the bottom side of the strip is located facing the bottom roller 72; the anode pairs or the anodes extend horizontally in a single large tank and are distributed between rollers between which the metal strip is fed horizontally.

Figure 3:
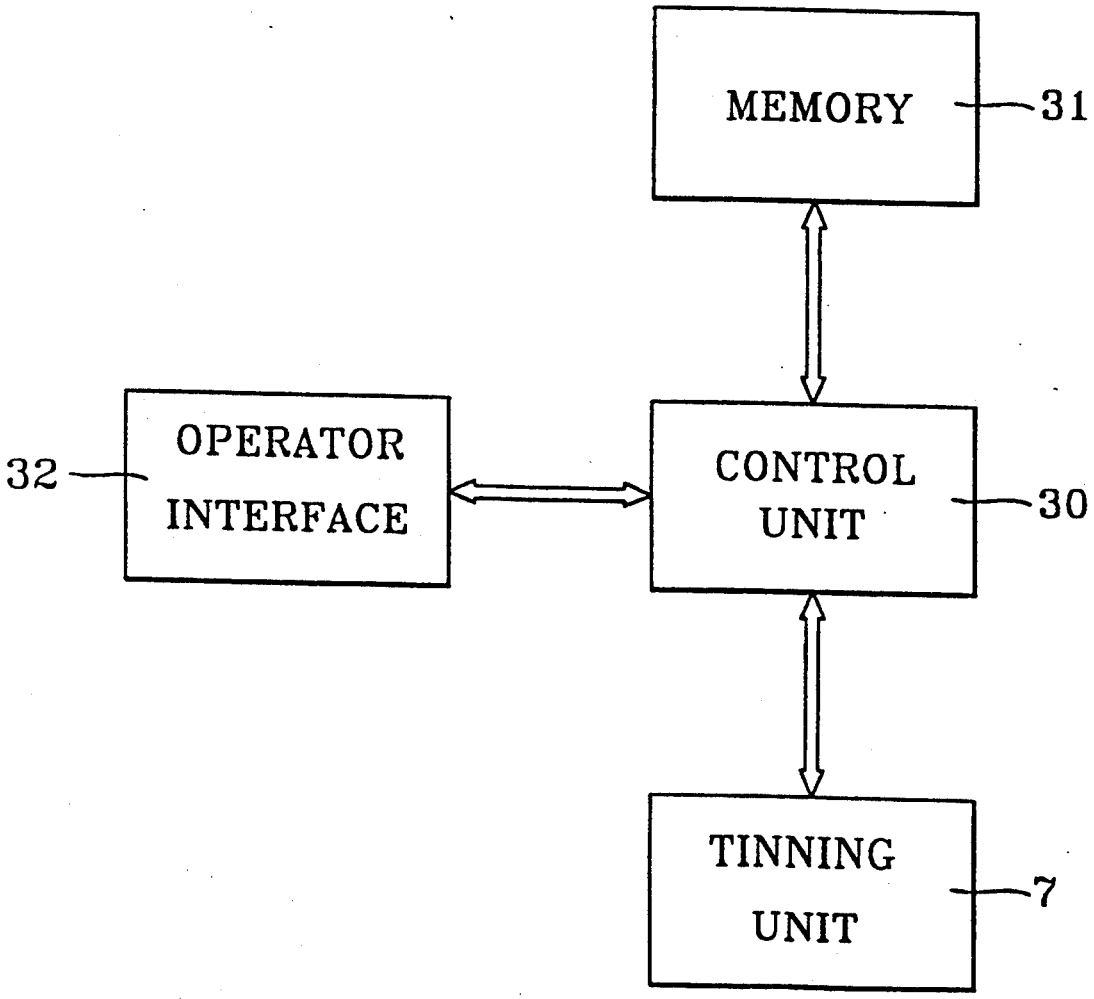
FIG. 3 is a block diagram of the tinning unit rectifier control circuit.

In the embodiment shown in FIG. 2 a strip increment passes through all the electrolysis tanks in succession, i.e. it receives on each side deposits of tin resulting from electrolysis conditioned by the rectifier current. In order for the coating specified for one side of the strip increment to be obtained the following condition must be satisfied $$\frac{INTENSITE}{VITESSE} = \frac{k \times LARGEUR \times REVETEMENT}{\rho}$$

in which:

INTENSITE is the current intensity "received" by the side of the increment;

VITESSE is the strip feed rate;

k is a constant dependent on the metal deposited and the units;

LARGEUR is the width of the increment;

REVETEMENT is the surface density so called tinning rate of the required coating of the side of the increment expressed in $g/m^2$; and $\rho$ is the electrolysis cathode efficiency. Referring to FIG. 3, a control circuit for controlling the rectifiers of the tinning unit 7 comprises a control unit 30 connected to the tinning unit 7 to receive measurement information for display and to transmit commands including rectifier regulation commands. The control unit is also connected to a programmable memory 31 in which the control algorithm and the values calculated by this program are stored. Finally, the control unit is connected to an operator interface 32 comprising a screen, an alphanumeric keyboard and a printer, for example, for an operator to enter data in relation to the strip to be tinned and to read off in real time the various tinning parameters and data in relation to the strip transmitted to the memory 31 by data processing means external to the control circuit.

The determination of the current orders for the rectifiers in the tinning unit 7 in accordance with the invention made up by the steps of the algorithm programmed into the memory 31 is explained below with reference to FIGS. 4, 5, 6, 7 and 8. This algorithm has a setting up first part E40 through E76 which determines the necessary total current to be applied to one side of the strip by all the rectifiers, the number of rectifiers to be put into operation and the predicted current intensity to be supplied by each rectifier. The algorithm has a calculation second part E80 through E87 in which the order for each rectifier is calculated as a function of the total current to be applied to the strip side and the current already applied by the preceding rectifiers.

The algorithm is executed cyclically with a predetermined period for each of the sides to be tinned of, for example, 500 ms. The algorithm period is fixed and is independent of the fixed length of the strip increments or of the variable feed rate of the strip in the tinning unit 7.

In the remainder of this description only one side to be tinned is considered, the rectifiers associated with this side, whether it is the top or the bottom side, being denoted $R_1$ through $R_N$.

Figure 4:
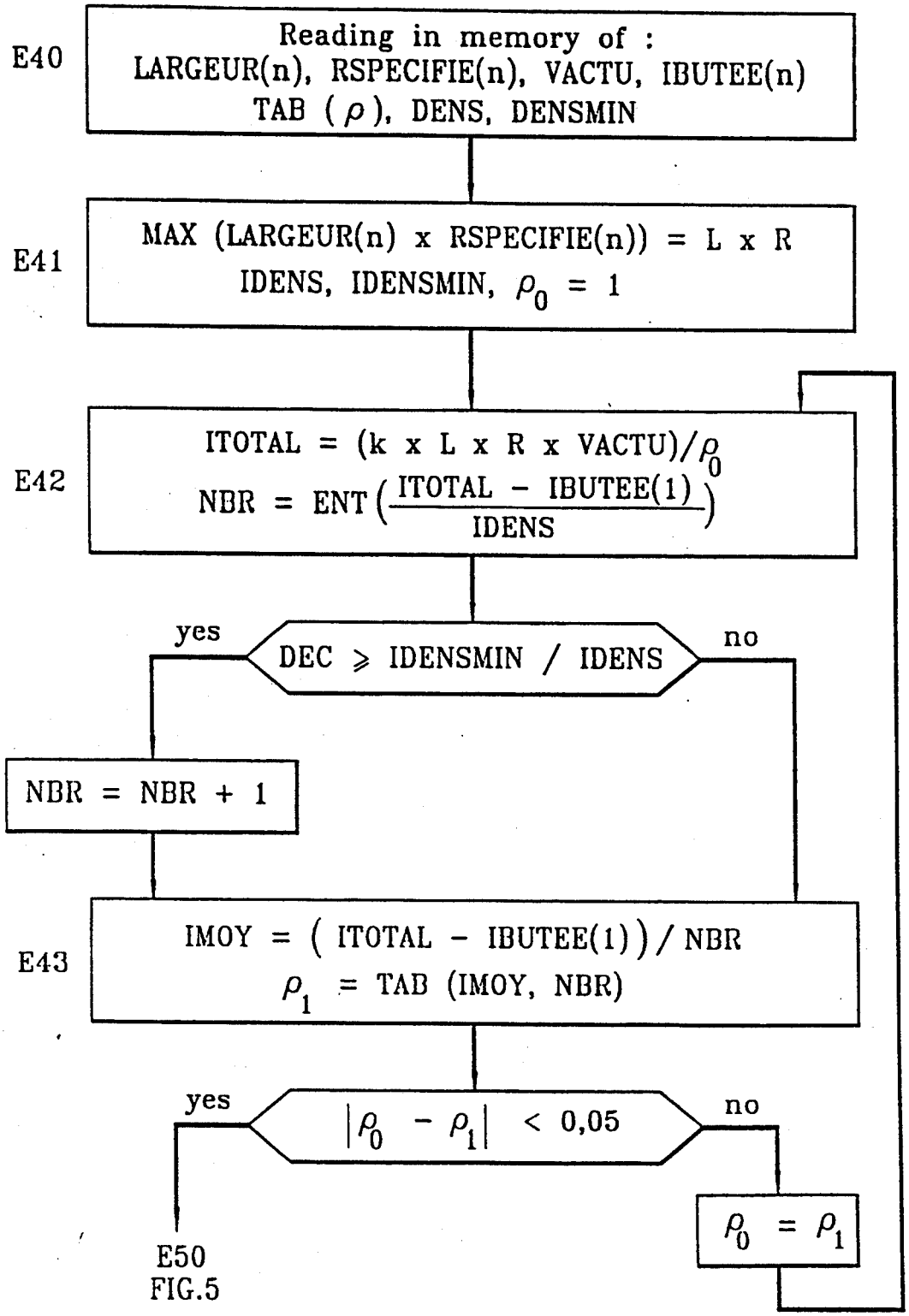
FIG. 4 is an algorithm for determining the total current, the number of rectifiers to be put into operation and the mean current per rectifier put into operation for tinning a strip of metal.

With particular reference to FIG. 4, the algorithm for determining the total current to be applied, the number of rectifiers to be put into operation and the average current per rectifier put into operation to tin one strip side comprises the following steps E40 through E43.

Step E40 consists in reading in memory of:

the width of each strip increment: LARGEUR(n) with $1 \leqq n \leqq N$, with reference to the N strip increments present at a given time in a tinning unit 7 with N tanks $71_1$ through $71_N$, the specified coating rate for each increment in $g/m^2$: RSPECIFIE(n), with $1 \leqq n \leqq N$, the maximal current intensity supplied by each rectifier in amperes: IBUTEE(n), with $1 \leqq n \leqq N$, the strip feed rate: VACTU, the cathode efficiency table according to the number of rectifiers put into operation and the average current intensity supplied by these rectifiers: TAB($\rho$), and the current density in $A/dm^2$ which the operator requires to use and the minimal current density in $A/dm^2$ which the operator does not wish the current density to fall below: DENS and DENSMIN, respectively.

The values of LARGEUR(n) and RSPECIFIE(n) depend on the strip to be tinned and the coating required on the strip side. The values of IBUTEE(n) are defined by the operator for each rectifier and represent a current limit (clamping) of the rectifiers. The strip feed rate VACTU is sampled cyclically in the feed rate measuring device and stored. The cathode efficiency table is held in memory.

The current density DENS and minimal current density DENSMIN are defined by the operator. These latter two parameters are taken into account to improve the appearance of the tinned strip. Phenomena to be avoided such as "bare edges" are dependent on the current density impinging on the strip and independent of the total current and therefore the coating thickness.

Step E41 involves calculating the following products relating to the N increments of the strip 1 present in the unit 7: LARGEUR(n)×RSPECIFIE(n) for $1 \leqq n \leqq N$ and determining the greater of these products, denoted L×R. Determining the greater of these products is justified for imposing overcoating as compared with undercoating in the vicinity of a weld between two consecutive strips to receive different thickness coatings.

As an alternative, RSPECIFIE(n) is replaced by a coating rate RVISE(n) previously calculated as follows: RVISE(n)=A×RSPECIFIE(n)+B×RSPECIFIE AUTRE FACE(n)+C, in which RSPECIFIE AUTRE FACE(n) is the coating rate specified for the other side of the strip increment and A, B and C are constants. The constant B depends on the leakage current between the two sides of the strip and on the specified coating rate for the side in question.

In step E41 current intensity values IDENS and IDENSMIN corresponding to the current densities DENS and DENSMIN are also calculated on the basis of the width corresponding to the product L×R determined with either RSPECIFIE (n) or as an alternative RVISE (n).

Finally, the cathode efficiency $\rho_o$ is initially set at 1.

Step E42 includes calculating the total current intensity required to coat the most "demanding" increment, i.e. that corresponding to the product L×R:

$$ITOTAL = k \times \frac{L \times R}{\rho o} \times VACTU.$$

In step E42 a number NBR of rectifiers to be put into operation, in addition to the first rectifier $R_1$, and dependent on the calculated total current ITOTAL is also calculated; the first rectifier is necessarily put into operation and supplies the constant current intensity IBUTEE(1) and each subsequent rectifier put into operation delivers the current intensity IDENS:

$$NBR = ENT\left(\frac{ITOTAL - IBUTEE(1)}{IDENS}\right).$$

In the above equation ENT is the integer part of the quotient of the division (ITOTAL−IBUTEE(1))/IDENS. The decimal part of this division is denoted DEC.

If the decimal part DEC is equal to or greater than the ratio IDENSMIN/IDENS, then the number NBR is increased by 1.

Step E43 includes calculating the average current intensity IMOY supplied by each of the NBR rectifiers put into operation, the first rectifier supplying IBUTEE(1):

$$IMOY = \left(\frac{(ITOTAL - IBUTEE(1)}{IDENS}\right).$$

Step E43 also verifies that the calculations are convergent, by determining the cathode efficiency $\rho_1$ as a function of the current intensity IMOY and the number NBR of rectifiers put into operation, using the cathode efficiency table TAB ($\rho$).

If the absolute value of the difference ($\rho_O - \rho_1$) is greater than a predetermined threshold the calculations are begun over, starting from the calculation of ITOTAL (step E42) using the new cathode efficiency value $\rho_1$. The values of ITOTAL, NBR and IMOY are calculated again and a new cathode efficiency is determined from the table TAB($\rho$); the calculations are begun again as many times as necessary to achieve convergence. In practise, with a threshold set at 0.05, two or three iterations are sufficient. As an alternative to this, ITOTAL, NBR and IMOY are calculated once only with a fixed cathode efficiency equal to 1, for example, and the convergence of the calculations is no checked. Although less accurate, this alternative does not need the table TAB ($\rho$).

After determining the values ITOTAL, NBR and IMOY the algorithm goes on to the part which calculates the predicted rectifier current intensities. This part is made up of steps E50 through E54 for determining the predicted current intensities of the first and last rectifiers $R_1$ and RN, steps E60 through E64 for determining the predicted current intensities of the other rectifiers $R_2$ through $R_{N-1}$, and steps E70 through E76 for correcting the predicted current intensities.

Figures 5, 6:
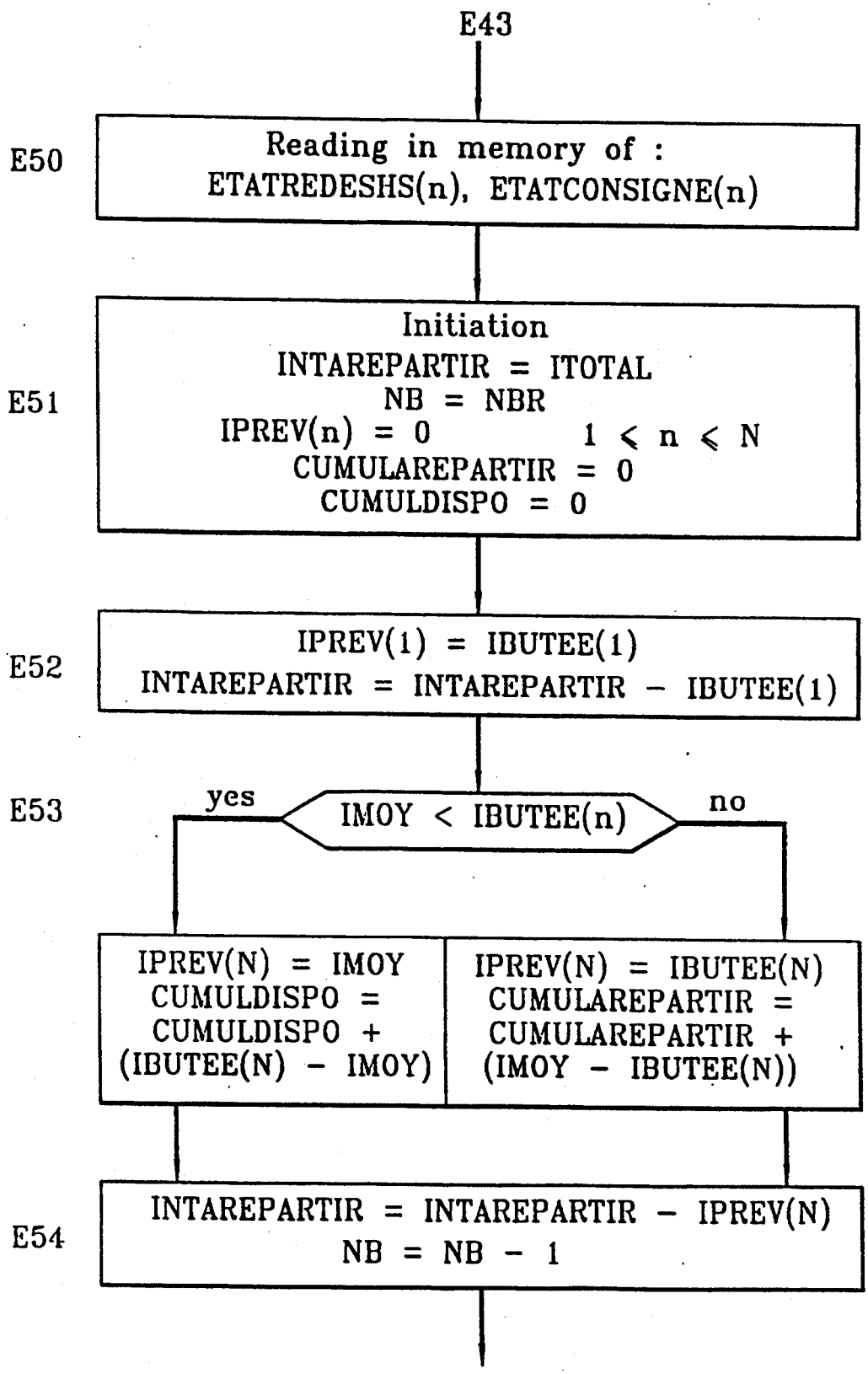
FIG. 5 is an algorithm of determining predicted currents for the first and last rectifiers of the tinning unit.
FIG. 6 is an algorithm for determining predicted currents for rectifiers other than the first and last rectifiers of the tinning unit.
Figure 6:
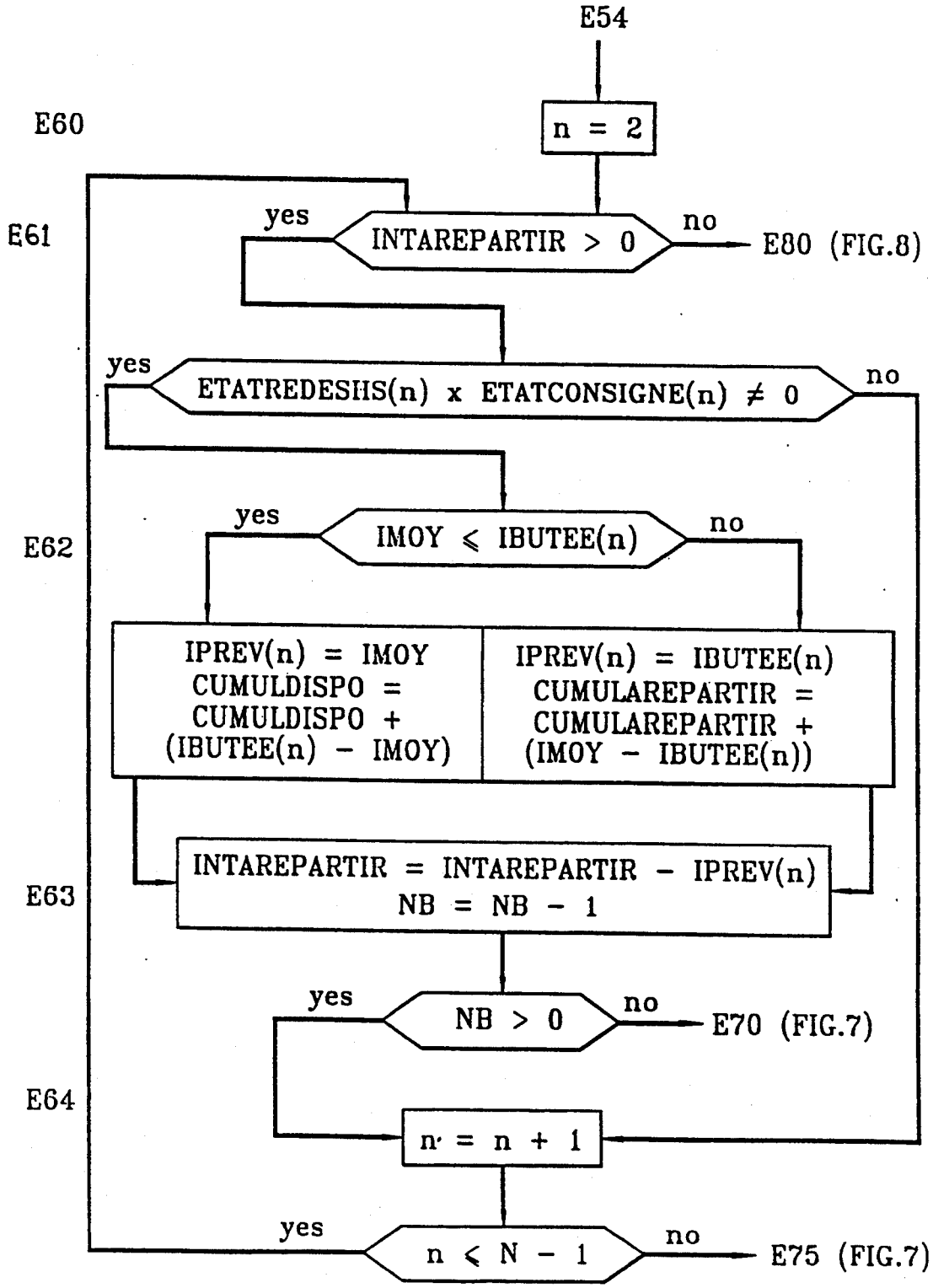

Referring to FIG. 5, step E50 consists in reading in memory of:

- the in-service or out-of-service status of each rectifier: ETATREDESHS(n), with $1 \leqq n \leqq N$, which is a logic value taking the value "1" if the rectifier $R_n$ is in-service, i.e. able to supply current, or "0" otherwise,
- the reserved or unreserved status of each rectifier: ETATCONSIGNE(n), with $1 \leqq n \leqq N$, which is a logic value set by the operator taking the value "0" if the rectifier is reserved, i.e. if the operator wishes to use it only if absolutely necessary, or "1" if the rectifier is unreserved.

To clarify the above, any rectifier Rn, with $1 \leqq n \leqq N$, can be in any of the following states.

It can be out-of-service, for example undergoing maintenance; it is not able to supply current and will not be put into operation.

It can be in-service, in which case it is able to supply current.

If the rectifier $R_n$ is in-service, it can be unreserved in which case it is selectable by the algorithm without restriction to be put into operation, i.e. actually to supply current.

If the rectifier $R_n$ is in-service, it can be reserved, in which case it is chosen by the algorithm to be put into operation only if absolutely necessary, as explained below.

Working variables are initialized in step E51, together with the predicted current intensity values to be supplied by the rectifiers $R_1$ through RN: IPREV(n), with $1 \leqq n \leqq N$. The working variables are:

- INTAREPARTIR: current intensity to be distributed, initialized to the value ITOTAL calculated in step E42;
- NB: number of rectifiers to be used, in addition to the first, initialized to the value NBR calculated in step E42;
- CUMULAREPARTIR: cumulative total current intensity that the rectifiers cannot supply, by virtue of current limiting, initialized to the value "0"; and
- CUMULDISPO: cumulative current intensity that the rectifiers which have not yet reached their maximal current intensity can still supply, initialize to the value "0".

Step E52 concerns calculating the predicted current intensity IPREV(1) supplied by the first rectifier $R_1$ in the tinning unit 7. As already mentioned, the first rectifier is always put into operation and supplies the constant current intensity IBUTEE(1) defined by the operator and is therefore not regulated. Alternatively, the first rectifier supplies the current IMOY if the value IMOY is less than the value IBUTEE(1), or IBUTEE(1) otherwise. In either case the working variable INTAREPARTIR is updated.

The last rectifier $R_N$ is used in priority after the first rectifier $R_1$ and before all the other rectifiers $R_2$ through $R_{N-1}$. Step E53 determines the predicted current intensity IPREV(N) supplied by the last rectifier of the tinning unit. The current intensity IPREV(N) is equal to IMOY if the value IMOY is less than the value IBUTEE(N) or equal to IBUTEE(N) otherwise. In the former case the working variable CUMULDISPO is updated, allowing for the fact that a current intensity equal to IBUTEE(N)−IMOY can still be assigned to the rectifier $R_N$ if necessary, as explained below. In the latter case, the working variable CUMULAREPARTIR is updated, allowing for the fact that the current intensity equal to IMOY−IBUTEE(N) cannot be assigned to the rectifier $R_N$ and must be distributed between the other rectifiers.

In step E54 the working variables INTAREPARTIR representing the current intensity remaining to be distributed and NB representing the number of rectifiers remaining to be tested are updated.

The algorithm then goes on to steps E60 through E64 to calculate the predicted current intensities of the other rectifiers $R_2$ through $R_{N-1}$.

Referring to FIG. 6, the remainder of the current to be distributed, equal to ITOTAL−IPREV(1)−IPREV(N), is distributed to (NBR−1) rectifiers out of rectifiers $R_2$ through $R_{N-1}$ which are in-service and unreserved.

In step E60, the parameter n is initialized to 2, corresponding to rectifier $R_2$, and then in step E61 the variable INTAREPARTIR is compared to zero to determine if there is any current remaining to be distributed. If the result is "no", the algorithm proceeds direct to step E80 described below. If the result is "yes", the in/out-of-service status and the reserved or unreserved status of the rectifier $R_n$ are tested. If the rectifier $R_n$ is either out-of-service or reserved the algorithm proceeds to step E64. If the rectifier $R_n$ is in-service and unreserved the predicted current intensity IPREV(n) of the rectifier $R_n$ is calculated in step E62. The variables CUMULAREPARTIR or CUMULDISPO are calculated and updated in exactly the same way as in step E53 relating to the rectifier $R_N$. Then in step E63 the current remaining to be distributed is updated and the number NB of rectifiers remaining to be tested is updated and tested.

If the number NB is null, NBR rectifiers other than the rectifier $R_1$ have been tested and the algorithm proceeds to step E70 described below.

Step E64 increments the parameter n and if n is less than or equal to the value N−1, i.e., if there remains at least one rectifier to be tested, the algorithm loops to step E61 previously described. Otherwise the algorithm proceeds to step E75 described below.

Step E62 for determining the predicted current intensities IPREV(n) runs as long as there remains intensity to be distributed, according to step E61, as long as the number NBR of rectifiers to put into operation has not been reached, according to step E63, and as long as not all the rectifiers $R_2$ through $R_{N-1}$ have been tested, according to step E64.

If all of the current intensity to be distributed ITOTAL is distributed to at most NBR+i rectifiers, including rectifier $R_1$, rectifier $R_N$ and NBR−1 rectifiers out of the rectifiers $R_2$ through $R_{N-1}$, the calculated predicted current intensities IPREV(n) with $1 \leqq n \leqq N$ are memorized. Some current intensities IPREV(n) can be null, for example if a rectifier is out-of-service or if NBR+1 is less than N.

If it has not been possible to distribute all of the current intensity to be distributed, then the distribution process is begun again. Various options are possible at this stage.

Figure 7:
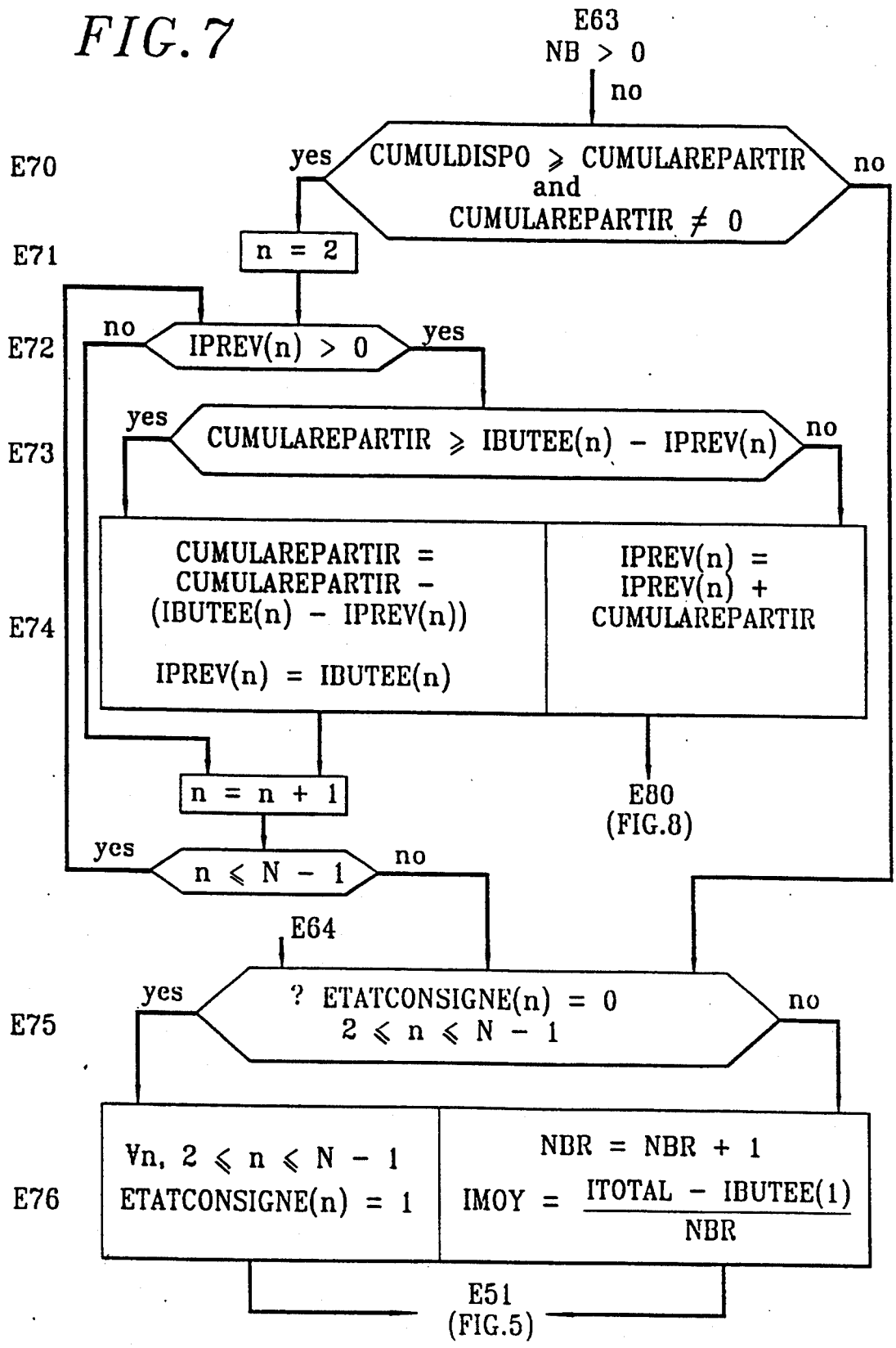
FIG. 7 is an algorithm for correcting the predicted currents of the rectifiers.

Referring to FIG. 7, steps E70, E71, E73 and E74 are executed if the number of rectifiers to be put into operation has been reached and it has not been possible to distribute all of the current intensity to be distributed between the rectifiers put into operation, i.e., if CUMULAREPARTIR remains positive, and if the rectifiers already put into operation are still available to supply the current intensity remaining to be distributed, i.e., if the value of CUMULDISPO is greater than or equal to CUMULAREPARTIR. Distributing the current intensity then entails saturating the rectifiers put into operation at their respective value IBUTEE(n) starting with rectifier $R_2$. If these conditions are met in step E70, the variable n is initialized to 2 in step E71 to execute the steps E72, E73 and E74 rectifier by rectifier starting from rectifier $R_2$.

The calculated predicted current intensity IPREV(n) is tested in step E72; if it is null, rectifier $R_n$ is not put into operation and n is incremented by 1 in order to go to the next rectifier. If the current intensity IPREV(n) is not null, step E73 verifies if the current intensity remaining to be distributed CUMULAREPARTIR is greater than or equal to that which can still be assigned to the rectifier $R_n$, i.e. IBUTEE(n)−IPREV(n). Depending on the result of step E73, the predicted current intensity IPREV(n) is recalculated in step E74.

If the current intensity remaining to be distributed CUMULAREPARTIR is not greater than or equal to the value IBUTEE(n)−IPREV(n), then the current intensity IPREV(n) is increased by the value CUMULAREPARTIR. This means that there is no longer any current intensity to be distributed and the calculation of the predicted current intensities IPREV(n) is completed. The algorithm goes to step E80 described below.

If the current intensity remaining to be distributed CUMULAREPARTIR is greater than or equal to the value IBUTEE(n)−IPREV(n) then IPREV(n) takes the value IBUTEE(n) and CUMULAREPARTIR is reduced by IBUTEE(n)−IPREV(n). As in this case there still remains current intensity to be distributed (CUMULAREPARTIR), the calculation is begun again for the next rectifier starting from step E72 and continues up to rectifier $R_{N-1}$ at most.

If the conditions of step E70 are not satisfied, i.e. if the value of CUMULAREPARTIR is greater than the value of CUMULDISPO, or if it is not possible to obtain a null value for CUMULAREPARTIR by saturating rectifiers put into operation in step E74, or if in step E64 all rectifiers from $R_2$ to $R_{N-1}$ have been tested and the number of rectifiers to be put into operation has not been reached, because there are too many rectifiers that are reserved, then step E75 verifies if rectifiers are reserved. If the result is positive, then step E76 overrides the reserved status of all the reserved rectifiers from $R_2$ through $R_{N-1}$. If the result is negative, the number NBR of rectifiers to be put into operation is increased by 1, if there are still rectifiers available, and the average current intensity IMOY is recalculated using this new value of NBR. In either case, after step E76 the calculation is resumed from step E51, either with the reserved status of all the rectifiers overriden or with new values of NBR and IMOY.

Steps E80 through E87 for determining current intensity orders to apply to each rectifier are described with reference to FIG. 8.

In step E80, the current intensity order IREF(1) of the first rectifier $R_1$ is equal to IBUTEE(1) since, as already explained with reference to this preferred embodiment, no regulation is applied to this rectifier which always operates at fixed current. The intensity/feed rate ratio [I/V]REF(1)=IBUTEE(1)/VACTU of the first rectifier is calculated and memorized strip increment by strip increment as the strip feeds; in other words this ratio is applied to the strip increment passing the anodes supplied by the rectifier $R_1$.

With each strip increment is associated the "history" deposit ratio [I/V]VECU(n) which is representative of the successive previous deposits on the increment and which is equal to the sum of the ratios [I/V]REF(i), with $1 \leqq i \leqq n-1$, that the increment passing the anodes $74_n$ or $75_n$ supplied by the rectifier $R_n$ has "received" from the preceding rectifiers. For a given strip increment the ratio [I/V]VECU (n) can be the sum of the averages of each term [I/V ]REF (i) with $1 \leqq i \leqq n-1$.

The current intensity orders IREF(n) for $2 \leqq n \leqq N-1$ are calculated from step E81. All the following calculations are carried out from rectifier $R_2$ through rectifier $R_{N-1}$ in succession. Alternatively, the order of the calculations can be reversed. Step E81 triggers the calculation for rectifier $R_2$. Step E82 then tests if the predicted current intensity IPREV(n) of rectifier $R_n$, with $2 \leqq n \leqq N-1$, calculated and memorized in step E62 or E74, is positive.

If IPREV(n) is null, then rectifier $R_n$ is not put into operation and the values IREF(n) and [I/V]REF(n) are null (step E83). The calculation for rectifier $R_n$ is finished and n is incremented by 1 (step E86) and if n is not equal to N the calculation is begun again from step E82.

If IPREV(n) is not null, then step E83 determines the values of [I/V]VECU(n), which is the sum of the terms [I/V]REF(i), with $1 \leqq i \leqq n-1$, which the increment passing the anodes $74_n$ or $75_n$ supplied by the rectifier $R_n$ has "received" from the preceding rectifiers $R_1$ through $R_{n-1}$. The value of the current intensity order IREF(n) is then the product of the difference between [I/V]VISE(n) and [I/V]VECU(n) by the measured feed rate VACTU less IPREV(N). In this calculation [I/V]VISE(n) is equal to $(k \times LARGEUR(n) \times R(n))/\rho$ where the value of R(n) is RSPECIFIE(n) or RVISE(n) depending on the alternatives. The term IPREV(N) is because the rectifier $R_N$ is always put into operation.

If it is not null, the current intensity order IREF(n) is limited by IDENSMIN and IPREV(n). If IREF(n) is less than, respectively more than this range, the value of IREF(n) is IDENSMIN, respectively IPREV(n). Alternatively, the order IREF(n) can be limited to a value INTMAX(n), the maximum current intensity that can be supplied by the rectifier Rn, the voltage of which can be saturated.

The value [I/V]REF(n) is calculated in step E85 and its value is IREF(n)/VACTU. The value [I/V]REF(n) is memorized strip increment by strip increment, i.e., it is assigned to the strip increment passing the anodes supplied by the rectifier $R_n$. The value [I/V]REF(n) is used to calculate the value of [I/V]VECU(n+1) as previously explained. In step E86 the parameter n is incremented by 1 to advance to the next rectifier and if n is not equal to N the calculation for the next rectifier starts from step E82.

When all the orders IREF(2) through IREF(N−1) for the rectifiers $R_2$ through $R_{N-1}$ have been calculated, the current intensity order IREF(N) for rectifier $R_N$ is calculated in the next step E87.

Step E87 determines the "history" [I/V]VECU(N) which is the sum of the terms [I/V]REF(i), with $1 \leqq i \leqq N-1$, which the increment passing the anodes $74_N$ or $75_N$ supplied by the rectifier $R_N$ has received from the preceding rectifiers. The current intensity order IREF(N) of the last rectifier $R_N$ in the unit 7 is then calculated. The order IREF(N) is equal to ([I/V]VISE(N)−[I/V]VECU(N))×VACTU. The value of the term [I/V]VISE(N) is $(k \times LARGEUR(N) \times R(N))/\rho$, where R(N) is RSPECIFIE(N) or RVISE(N), depending on the alternatives.

The order IREF(N) is never null and must lay between IDENSMIN, the minimal intensity determined in step E41, and IBUTEE(N). If IREF(N) is less than, respectively more than this range, then it is assigned the value IDENSMIN, respectively IBUTEE(N). After IREF(N) is calculated the term [I/V]REF(N) is determined. When all the current intensity orders have been calculated the orders are applied to the rectifiers.

Another cycle, typically of 500 ms duration, is then started from step E40.

As already mentioned, the regulation method according to the invention is duplicated if different or the same coatings are to be deposited on the two sides of the metal strip. Each of the two methods runs in parallel with the other and is associated with respective initial parameters RSPECIFIE, IBUTEE, DENS, DENSMIN, etc., related to the coating itself and to the rectifiers connected to the anodes facing the associated side of the strip.

The regulation method according to the invention has been described with reference to a tinning line but applies to any type of electrolytic deposition such as electrolytic zinc plating.

What we claim is:

1. A method of regulating electrolytic deposition of a metal coating onto at least one side of a metal strip, said metal strip forming a cathode and being fed continuously at a set feed rate in an electrolyte past anodes, said anodes being supplied by respective controllable rectifiers having respective upper and lower current limits, said metal strip being divided into increments of fixed length, each increment having a predetermined width and a predetermined coating rate, said method starting with the determination of a total current required to coat said increments between the anodes as a function of said coating rate, width and feed rate, said method including the steps of:

(a) determining, in addition to a first rectifier continuously supplying a predetermined value of current to an anode associated with a portion of one side of the metal strip that has not been subjected to said electrolytic deposition, the number of additional rectifiers to be put into operation as a function of said required total current and said respective lower current limits of said rectifiers;

(b) determining a predicted current for each rectifier by distributing the required total current equally between said rectifiers to be put into operation between said respective upper and lower current limits; and (c) determining current values to be applied to the rectifiers to be put into operation, a current value for a given rectifier supplying a respective anode depending on the strip width and the coating rate of a strip increment passing said respective anode, and on the current values of the rectifiers preceding said given rectifier and being less than the predicted current of said given rectifier.

2. The method according to claim 1 implemented cyclically for each side of the strip.

3. The method according to claim 1 wherein said required total current is the current required to coat one of said strip increments having the highest product of width times coating rate.

4. The method according to claim 1 wherein said number of rectifiers to be put into operation depends on a required current density for said coating and a minimal current density.

5. The method according to claim 1 wherein said step of determining a predicted current for each rectifier depends on one of in-service and out-of-service status of said each rectifier and reserved and unreserved status of said rectifiers.

6. The method according to claim 1 wherein a null predicted current of one of the rectifiers produces a null current value for said one rectifier.

7. The method according to claim 1 wherein the step of determining the current value for each rectifier comprises calculating a ratio of the current value of said each rectifier and said feed rate of said metal strip and assigning said ratio to a strip increment passing said anodes supplied by said each rectifier.

8. The method according to claim 1 wherein a current order for said strip increment passing the respective anode supplied by said given rectifier is determined by calculating a history which is the sum of ratios of said current orders and said feed rate, said ratios being calculated for said rectifiers preceding said given rectifier and assigned to said strip increment passing said respective anode supplied by said given rectifier.

9. The method according to claim 1 wherein at least a last one of said rectifiers which supplies an anode after which said one metal strip side is coated with said metal coating, is always put into operation.

10. The method according to claim 1 wherein each of rectifiers put into operation receives a current order at least equal to a predetermined minimal value.

11. The method according to claim 1 wherein a non-null predicted current of one of the rectifiers produces a non-null current for said one rectifier.

12. The method according to claim 5 wherein said step of determining a predicted current for each rectifier does not depend on said reserved status of said rectifiers if it is not possible to distribute said required total current equally between rectifiers with the unreserved status.

* * * * *